United States Patent [19]

Osika

[11] 3,969,597

[45] July 13, 1976

[54] KEY OPERATED ELECTRIC GROUND SWITCH

[75] Inventor: Thomas F. Osika, Gary, Ind.

[73] Assignee: McGill Manufacturing Company, Inc., Valparaiso, Ind.

[22] Filed: Jan. 2, 1975

[21] Appl. No.: 537,901

[52] U.S. Cl. ..... 200/44; 200/153 L; 200/4

[51] Int. Cl.[2] ..... H01H 9/28

[58] Field of Search ..... 200/44, 42 R, 42 A, 200/42 T, 61.39, 4, 6 B, 153 LB, 153 LA, 155 R, 153 L; 70/DIG. 30, 237

[56] References Cited

UNITED STATES PATENTS

| | | | |
|---|---|---|---|
| 1,089,167 | 3/1914 | Wacker | 200/44 |
| 3,257,517 | 6/1966 | Sedley | 200/44 |

*Primary Examiner*—Robert K. Schaefer

*Assistant Examiner*—M. Ginsburg

*Attorney, Agent, or Firm*—Foorman L. Mueller

[57] ABSTRACT

A lockable electric grounding switch comprises a two-piece switch housing which has an upper conductive portion into which a hollow cylindrical insulating portion is inserted, with the two portions secured together. The upper conductive portion has a slot in it for accommodating a key, and cam surfaces are provided on the underside of the end of the conductive housing to cause the key to be cammed downwardly when it is rotated to push a resiliently biased metal contact out of engagement with a shoulder of the metal portion of the housing. This opens the circuit between a terminal mounted in the other end of the insulating portion of the housing. The contact and the terminal are normally electrically interconnected by a compression spring which biases the contact into engagement with the metal housing when the key is removed or is rotated to an "off" position.

9 Claims, 10 Drawing Figures

KEY OPERATED ELECTRIC GROUND SWITCH

BACKGROUND OF THE INVENTION

Electric grounding switches are frequently used on small internal combustion engines to short the ignition system and prevent the engine from running when the switch is turned to its off position. Such switches are applied to chain saws, power lawn mowers, and similar equipment.

Generally, such switches are of a toggle or slide type and do not include an integral locking feature to prevent unauthorized starting of the engine. As a safety feature, it is desirable to provide a locking switch which prevents the engine from being started by an unauthorized user. This is an important safety feature for equipment such as power lawnmowers, which possibly could be accidentally started by children who are unaware of the attendant dangers of operating such equipment.

Accordingly, it is desirable to provide for a grounding switch for internal combustion engines which is simple and economical to manufacture and which includes an integral locking feature to prevent unauthorized operation of the equipment with which such a switch is used.

SUMMARY OF THE INVENTION

Accordingly, it is an object of this invention to provide an improved electric switch.

It is another object of this invention to provide an improved key-operated electric switch.

It is a further object of this invention to provide an improved key-operated electric grounding switch.

It is yet another object of this invention to provide a key-operated electric switch of simple and economical construction.

It is still another object of this invention to construct a grounding switch with a two-part body portion, one of the parts made of insulating material and the other part made of conductive material, employing a spring to interconnect a movable contact with a conductive terminal mounted in the nonconductive portion of the housing, with a provision for insertion of an operating key into the conductive portion of the housing to engage the contact and to move it out of engagement with the conductive portion of the housing as the key is rotated.

In accordance with a preferred embodiment of this invention, an electric switch comprises a housing having an elongated hollow housing portion with a closed end and an open end, and a hollow conductive housing portion having a first end with an aperture in it, for accommodating a rotatable key, and a second open end for receiving and engaging the open end of the insulating housing portion in an assembled relationship. A terminal is mounted in the closed end of the insulating housing portion and extends outwardly from it. A conductive contact is movably located in the switch housing and is electrically connected to the terminal by a conductive compression spring which biases the contact into electrical conductive contact with a shoulder in the first end of the conductive housing portion of the switch housing. A cam surface on the inner surface of the first end of the conducting housing portion engages a projection or lobe on a key inserted into the aperture to cause the key to bias the conductive contact away from electrical contact with the conductive housing portion when the key is rotated from a first position to a second position within the conductive housing portion of the switch.

DETAILED DESCRIPTION

Figure 1:
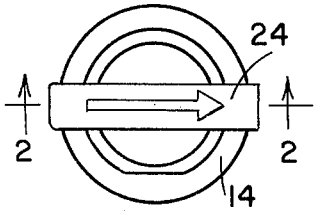
FIGS. 1 and 2 show a top view and a cut-away side view, respectively of a preferred embodiment of the invention with a key located in its insertion and removal position within the switch.

Referring now to the drawings wherein like reference numerals are used throughout the several figures to indicate the same or similar components, there are illustrated two different embodiments of a key operated grounding switch of a type suitable for use with internal combustion engines and the like for shorting out the ignition and preventing operation of the engine until a key is inserted into the switch and rotated to the "on" position of the switch.

Figure 2:
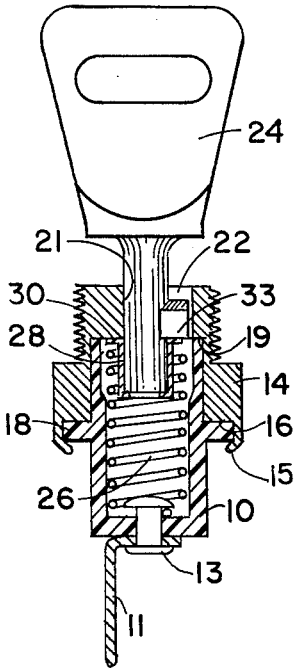

In FIGS. 1 and 2, there is shown a key operated electric grounding switch in which the switch body is in two portions. One of these portions comprises a cylindrically-shaped plastic insulating housing 10 having a closed lower end to which a conductive terminal 11 is attached by a rivet 13 extending through the closed bottom end of the plastic housing 10 into the interior. The rivet 13 may be made of copper or some other suitable electrically conductive material.

A second portion of the switch housing is made of electrically conductive metal, preferably die cast zinc, in the form of a cylindrical cap 14 for the plastic housing portion 10. The metal cap has a shoulder 16 on it which engages a flange 18, integrally formed as part of the plastic housing portion 10, so that the metal cap 14 receives the plastic housing 10 which also abuts against an upper shoulder 19 formed on the inside surface of the upper end of the cap 14. The upper portion of the cap 14 is exteriorly threaded to facilitate mounting of the switch into the metal frame or shroud of an engine with which it is to be used. A cylindrical hole 21 is formed in the center of the otherwise closed upper end of the cap 14, and a slot 22 extends to one side of the hole 21 to accommodate a lobe on a removable key 24 which is to be inserted into the switch housing to operate the switch.

The plastic and metal portions 10 and 14 of the switch housing are secured together by bending an extension 15 on the metal housing 14 over the flange 18 on the plastic housing portion 10 to clamp the flange 18 between the shoulder 16 and the bent over extension 15; thereby locking the two parts of the housing together.

Electrical contact between the terminal 11 and the conductive cap 14, which constitutes the second terminal of the switch, is effected through the rivet 13 which also is attached to a conductive compression spring 26 (preferably made of spring steel), which in turn engages a cup-shaped eyelet contact 28 having an outwardly flared upper portion 30 biased into electrical contact with the shoulder 19 of the cap 14 by the spring 26.

Figure 3:
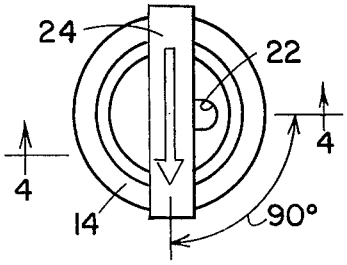
FIGS. 3 and 4 show top and partially cut-away side views, respectively, of the embodiment of FIGS. 1 and 2 with the key rotated 90°.
Figure 4:
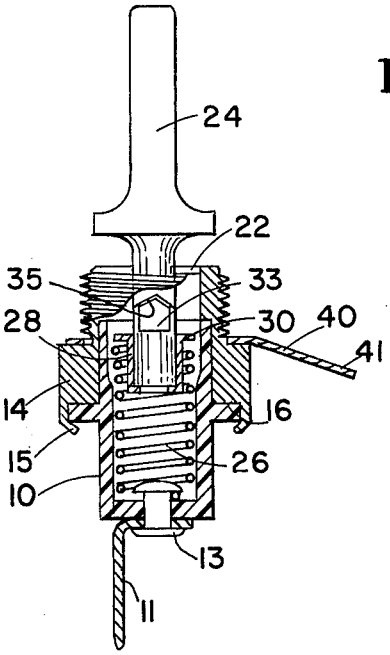

As shown in FIG. 2, when the key 24 is inserted into the switch a cylindrical shank 31 on the key fits into the contact eyelet 28, and a key lobe 33 is passed downwardly through the slot 22 in the top of the cap 14. When the key 24 then is rotated 90°, as shown in FIGS. 3 and 4, the cam surface of the lobe 33 engages a mating cam surface including detent 35 which cam surface is similiar to that shown in FIG. 7 formed on the inner surface of the upper portion of the cap 14 to cam the key 24 downwardly, as shown in FIG. 4. This presses the eyelet 28 out of engagement with the shoulder 19 of the cap 14 against the compression force of the spring 26. As a result the electrical contact which previously was made between the terminal 11 and the cap 14 through the spring 26 and the eyelet contact 28 is broken.

In the version shown in FIGS. 1, 2, 3 and 4, the switch in a two-position switch having an "on" position and an "off" position, shown respectively in FIGS. 1, 2 and 3, 4. The key 24 cannot be rotated any farther than 90°, because the lobe 33 on the key engages an abutment formed at the end of the cam surface 35 (shown most clearly in FIG. 2) to prevent further rotation of the key. When the key 24 once again is rotated to the position shown in FIGS. 1 and 2, the grounding switch is closed, making electrical contact between the terminal 11 and the cap 14; and the key may be removed to lock the switch in this position.

Figure 8:
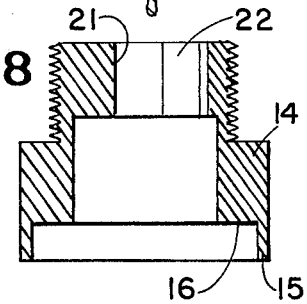
FIG. 8 shows cross-sectional view of the conductive cap portion of the embodiment illustrated in FIGS. 1, 2, 3 and 4.

FIG. 8 shows the upper metal cap or housing portion in cross-sectional view, without the key 24 in it to more clearly illustrate the cylindrical hole 21 and slot 22 for accommodating the key. Also in Fig. 8, the cap 14 is shown prior to the bending over of the extensions 15 to secure the cap to the flange 18 on the plastic housing portion 10.

Figure 5:
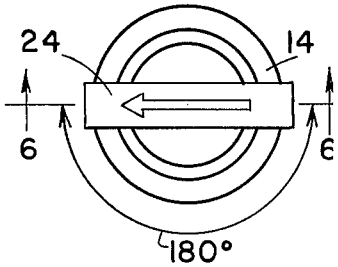
FIGS. 5 and 6 show top and partially cut-away side views, respectively, of a modification of the embodiment shown in FIGS. 1, 2, 3 and 4.
Figure 6:
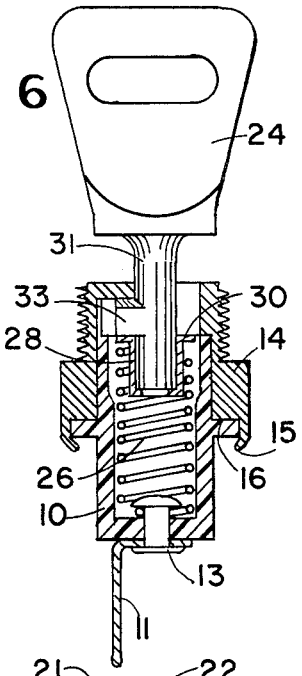
Figure 7:
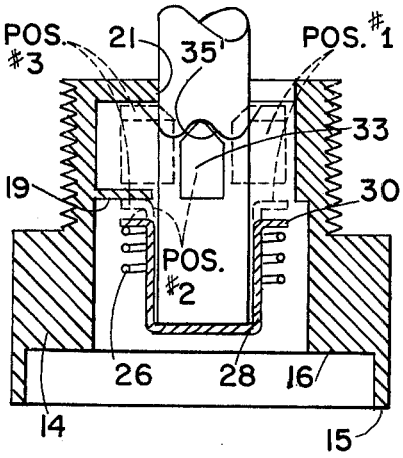
FIG. 7 shows additional details of a portion of the embodiment illustrated in FIGS. 5 and 6.

FIGS. 5, 6 and 7 illustrate an alternative embodiment of the invention accommodating three-positions of rotation of a key 24. This is effected by shaping the cam surface 35', formed on the inner surface of the upper end of the cap 14, to continue past the position shown in FIG. 4 to a hollowed out position 180° from the position illustrated in FIGS. 1 and 2. This permits the key 24 to rise within the cap 14 sufficiently high to permit the conductive eyelet 28 to once again engage the shoulder 19 to make electrical contact with it. Since there is no slot, however, about the lobe 33 of the key 25 when it is rotated to the position shown in FIGS. 5 and 6, the key is held in place in the switch. The remainder of the parts of the switch, however, are in the same conductive connected position as in FIGS. 1 and 2 when the key may be removed to place the switch in its lock position.

FIG. 7 illustrates the general shape of the cam surface 35' for the version of the switch shown in FIGS. 5 and 6. In FIG. 7 the second key position, corresponding to the position of the key in the switch shown in FIG. 4, is illustrated in solid lines; and the dotted line illustrations show the positions of the key and the eyelet conductor for each of the other two positions of the key 24.

Figure 9:
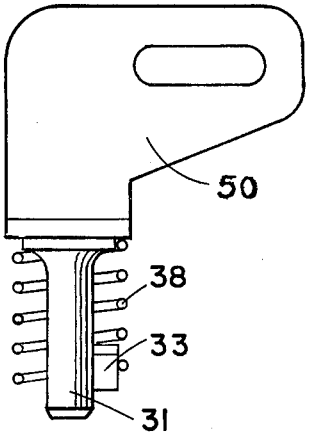
FIG. 9 shows an alternative embodiment of a key which may be used in conjunction with the apparatus illustrated in FIGS. 1 through 6.

FIG. 9 illustrates an alternative embodiment of a key 50 which includes a coil spring 38 fastened to the shank of the key around the shaft 31. When a key such as the key 50 shown in FIG. 9 is inserted into any of the switch configurations shown in FIGS. 1 through 8, it must be inserted with sufficient force to compress the spring 38 which engages the outer surface of the upper side of the cap 14. The key 50 then may be inserted and rotated in the manner illustrated for the key 24 in FIGS. 1 through 6. When the key 50 is rotated to the lock position of the switch, as illustrated in FIGS. 1 and 2, the spring 38 operates to push the key upwardly out of the switch.

Figure 10:
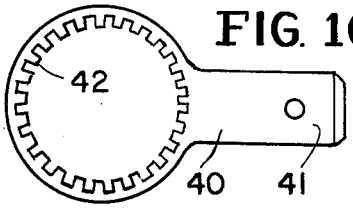
FIG. 10 shows a ground terminal lock washer which can be used in conjunction with the devices illustrated in FIGS. 1 through 6.

FIG. 10 illustrates a lock washer ground terminal 40 having a terminal projection 41 and including a thread engaging inner diameter 42. This lock washer is illustrated threaded into operating position onto the cap 14 of the switch in FIG. 4, and may be used in conjunction with the switch where the switch is used with engines which are mounted to plastic housings or the like. In such a mounting, the extension 41 accommodates a grounding connection to a suitable point.

As an alternative to the use of a plastic or non-conductive key 24, it is possible to use a metal key if the shaft 31 and lobe 33 are made of plastic or are coated with a suitable insulating material, such as nylon or the like.

I claim:

1. An electric ground circuit switch using the insertion of a key into the switch for changing the condition of an operating electric circuit in equipment which has a metal portion in which said switch is mounted for an electric connection through the switch and metal portion, said switch including in combination a hollow conduction portion having a closure wall at one end with a key-opening therein and being open at the other end, a hollow nonconductive portion which is open at one end and substantially closed at the other end, terminal means on said hollow nonconductive portion, means for electrically connecting said terminal means and said hollow conductive portion including a conductive compressible coiled spring positioned in said hollow non-conductive portion in conductive contact with said terminal means and also including a cup-shaped metal member positioned within said coiled spring and biased by said coiled spring into conductive contact with said hollow conductive portion at the key-opening end of the latter, a key insertable through said key opening end for positioning in said cup-shaped metal member, said key being rotatable from a first position to a second position and acting when so rotated to move said cup-shaped metal member out of conductive contact with said hollow conductive portion against the bias of said coiled spring to change the condition fo a grounding electric circuit through said terminal means and said coiled spring and said cup-shaped metal member to said hollow conductive portion, and means for maintaining said key in the rotated position with said cup-shaped member in the moved position, which latter position is out of electrical contact with said hollow conductive portion of said switch.

2. In a switch as defined in claim 1 wherein said key has a shank and lobe portion on said shank, and said closure wall of said hollow conductive portion has a cam surface on the inside thereof engageable by said key lobe portion upon rotation of said key from a first to a second position, with the engagement of said lobe portion and cam surface moving said key in a direction at right angles to the direction of rotation to thereby move said cup-shaped member.

3. In the switch of claim 2 wherein said cam surface acts to depress said key as it is rotated and in turn to depress said cup-shaped metal member out of electrical contact with said hollow conductive portion.

4. In a switch as defined in claim 1 wherein said closure wall at one end in said hollow conductive portion has a cam portion on the undersurface thereof with a detent therein and said key has a lobe portion thereon, with said lobe portion engaging said cam portion upon insertion and rotation of said key to urge the end portion of said key inwardly and thereby urge said cup-shaped member inwardly against the bias of said coiled spring, and with said lobe portion maintained in said detent in a rotated position for said key.

5. In a switch as defined in claim 4 wherein said hollow conductive portion permits rotation of said key through 180°, and said cam portion is so shaped as to provide three positions for said key upon a full 180° rotation thereof.

6. In a switch as defined in claim 1 including a washer therewith having a terminal projection thereon, said washer being in electrical and physical engagement with said hollow conductive portion and said terminal projection being engageable with said metal portion of said equipment.

7. A grounding circuit switch for an internal combustion engine adapted to be mounted in the metal portion of the engine including a hollow conductive portion mountable in the engine for electrical connection therewith, a hollow nonconductive portion secured to said conductive portion having therewith terminal means, a compressible coiled conductive spring within said nonconductive portion and in electrical connection with said terminal means movable therein, conductive means with said spring having a key receiving portion and said conductive means adapted to be moved in and out of electrical contact position with said hollow conductive portion upon expansion and compression respectively of said spring, a key having at least a portion thereof which is nonconductive insertable in said conductive portion to engage and depress said conductive means for the purpose of moving the same out of contact with said hollow conductive portion and compressing said coiled spring upon the depressing movement, and means for maintaining said key in the depressed position.

8. In the switch of claim 7 wherein said conductive means is a cup-shaped member resting in said coiled spring and adapted to receive the forward end of the key therein, with said key being manually rotatable upon insertion and having a lobe portion thereon acting with said key maintaining means for locking said key in a rotated position.

9. In the switch of claim 7 wherein said key is wholly of nonconductive material and has a handle portion at one end and a shank with a lobe portion thereon displaced from said handle portion, and a coiled spring on the shank between the handle and lobe portions.

* * * * *